US010457479B2

(12) United States Patent
Harrison

(10) Patent No.: US 10,457,479 B2
(45) Date of Patent: Oct. 29, 2019

(54) NESTED LINER ASSEMBLY FOR A TRASH RECEPTACLE WITH LID

(71) Applicant: Joe Louis Harrison, Columbia, SC (US)

(72) Inventor: Joe Louis Harrison, Columbia, SC (US)

( * ) Notice: Subject to any disclaimer, the term of this patent is extended or adjusted under 35 U.S.C. 154(b) by 73 days.

(21) Appl. No.: 15/617,848

(22) Filed: Jun. 8, 2017

(65) Prior Publication Data

US 2018/0105357 A1 Apr. 19, 2018

Related U.S. Application Data

(60) Provisional application No. 62/410,057, filed on Oct. 19, 2016.

(51) Int. Cl.
*B65F 1/06* (2006.01)

(52) U.S. Cl.
CPC ..... *B65F 1/067* (2013.01); *B65F 1/062* (2013.01); *B65F 1/068* (2013.01); *B65F 2220/12* (2013.01)

(58) Field of Classification Search
CPC ..... B65F 1/062; B65F 1/067; B65F 1/068; B65F 2220/12; B65F 1/06; B65F 1/141; B65F 1/1415; B65F 1/04; B65F 1/0006; Y10S 220/908; Y10S 220/9081
USPC ..... 220/495.06, 495.07, 495.08, 495.09, 220/495.1, 495.11, 908, 908.1, 528; 248/95, 97, 98, 99, 100, 101
See application file for complete search history.

(56) References Cited

U.S. PATENT DOCUMENTS 3,888,406 A * 6/1975 Nippes ..... B65F 1/062 206/554
4,765,579 A * 8/1988 Robbins, III ..... B65F 1/06 220/495.04
4,869,391 A * 9/1989 Farrington ..... B65F 1/062 220/495.07

(Continued)

FOREIGN PATENT DOCUMENTS

DE 102007046741 * 6/2009 ..... B65F 1/062
JP 3013488 U 7/1995
JP 11-208804 A 8/1999

(Continued)

OTHER PUBLICATIONS

U.S. Appl. No. 15/421,562, filed Feb. 1, 2017.

(Continued)

*Primary Examiner* — Fenn C Mathew
*Assistant Examiner* — Elizabeth J Volz
(74) *Attorney, Agent, or Firm* — BakerHostetler

(57) ABSTRACT

A nested liner assembly includes a plurality of nested plastic film liners held by a lifter placed inside an insert fitted to the rim of a trash receptacle. The trash receptacle may have a hinged lid. The insert is adjacent the rim except near the hinge of the receptacle's lid where it extends on the outside of the receptacle below the lid and around the hinge. The two ends of the insert may be fastened together below the hinge to hold the insert in position without interfering with the operation of the lid. The lifter rests in a channel formed in the insert where the insert holds the liners open for use. The nested liners extend through the lifter and are held in place by a plurality of fasteners on the exterior surface of the lifter.

16 Claims, 11 Drawing Sheets

(56) References Cited

U.S. PATENT DOCUMENTS 5,957,319 A * 9/1999 Shane da Costa ..... B65F 1/06
220/252
6,139,185 A * 10/2000 Hamilton ..... B65D 33/14
383/11

FOREIGN PATENT DOCUMENTS

| | | |
|---|---|---|
| KR | 20-0455945 | 10/2011 |
| KR | 20-2015-0002613 U | 7/2015 |
| WO | WO 2016/033042 A1 | 3/2016 |

OTHER PUBLICATIONS

"Stack-a-Sac Nested Trashbag System with 120 Bags"; http://www.qvc.com/Stack; QVC, Inc.; ©1995-2018; accessed Oct. 10, 2016; 3 pages.
International Patent Application No. PCT/US2017/057197; Int'l Written Opinion and Search Report; dated Jan. 30, 2018; 14 pages.

* cited by examiner

NESTED LINER ASSEMBLY FOR A TRASH RECEPTACLE WITH LID

CROSS REFERENCE TO RELATED APPLICATION

The present application claims priority to U.S. application 62/410,057, filed Oct. 19, 2016, the entirety of which is incorporated herein by reference.

TECHNOLOGY FIELD

The disclosure relates generally to plastic liners or bags for use in trash receptacles. More particularly, the disclosure relates to an assembly of plural, nested liners for sequential use with a trash receptacle.

BACKGROUND

Bags or liners made of plastic have found widespread use in facilitating the collection of refuse and trash. A liner is used to cover the interior surface of a trash receptacle thereby serving to keep the interior surface of the receptacle cleaner and to also facilitate removal of the trash from the receptacle. A liner is a bag, typically a thin plastic bag, with an opening. The opening of the liner is either dimensioned to fit over the rim of a trash receptacle or is resilient-enough to be stretched over the receptacle's rim or may be tied to the rim with a twist tie or other securement. When the receptacle needs to be emptied, the liner with the trash inside it is removed from the receptacle, with the liner serving as a convenient container for the trash. After removal, a new liner may be inserted into the trash receptacle and then tied, for example, with a twist tie near its rim.

Liners facilitate the gathering of trash and they help to keep the inside of a trash receptacles clean, and they also protect those collecting trash. The edges of the liner mouth are simply gathered together and used to lift the liner free of the receptacle, so there is usually no need to touch the trash itself or to clean the receptacle that had a liner. A new replacement liner is then inserted into the receptacle.

Despite the use of liners, it takes time and effort to gather trash. For example, an office building may have hundreds of trash receptacles, each of which is emptied of trash daily. A more efficient and productive way to collect trash from receptacles would be well-received.

Some trash receptacles have lids which may be hingedly (i.e., via a hinge or hinge mechanism) attached to the main receptacle. These types of containers range from kitchen trash receptacles to large trash units that are used to move household trash to the curbside from a home for pickup by teams of sanitation workers. Liners for use in receptacles without hinged lids do not work very well in trash receptacles with hinged lids because of the hinge connection between lid and trash receptacle. Thus, there remains a need for a way to make removal of trash from hinged lid trash receptacles better.

SUMMARY

A nested liner assembly includes a plurality of trash receptacle liners, one liner inside the other. Removal of an innermost liner from the other liners leaves the remainder of the liners, including the next innermost liner, ready for use in the trash receptacle. A feature of the present disclosure is that, unlike the prior art, the present nested liner assembly accommodates the hinged lid of a trash receptacle. The nested liner assembly is put onto the trash receptacle, secured behind the hinge, and then the innermost liner may be removed first, leaving the next liner for use, continuing in the same manner until the liners are filled and removed in sequence. The lid may be closed when the receptacle is not in use. The number of liners may be a large number depending on the thickness of the liner.

Aspects of the present disclosure relate to a nested liner assembly, comprising: a plurality of liners, a liner of the plurality of liners being inside a next liner of the plurality of liners, the liner having an edge defining an opening into an interior of the liner, the plurality of liners including an innermost liner and an outermost liner. An insert operable may be inserted into a trash receptacle, the insert defining a channel. A lifter may be dimensioned to fit into the channel so that the plurality of liners is removably attached to the insert. At least one lift strap may be attached to the lifter and operable to lift the lifter from the channel of the insert.

Aspects of the present disclosure relate to a nested liner assembly, comprising: a plurality of liners, a liner of the plurality of liners being inside a next liner of the plurality of liners, the liner having an edge defining an opening into an interior of the liner, the plurality of liners including an innermost liner and an outermost liner. An insert may be inserted into a trash receptacle. The insert may define a channel and may be coupled to tubing such that the tubing is disposed within an interior of the trash receptacle. A loading device may be configured to fit into the channel of the insert. The plurality of liners may be removably attached to the loading device. At least one lift strap may be attached to the lifter and operable to lift the lifter from the channel of the insert.

Those skilled in the art of trash collection materials and methods will appreciate these and other features and their advantages from a careful review of the Detailed Description accompanied by the following drawings.

BRIEF DESCRIPTION OF THE DRAWINGS

Referring now to the drawings.

Additional advantages of the disclosure will be set forth in part in the description which follows, and in part will be obvious from the description, or may be learned by practice of the disclosure. The advantages of the disclosure will be realized and attained by means of the elements and combinations particularly pointed out in the appended claims.

DETAILED DESCRIPTION

The disclosure describes a nested liner assembly for containers with lids. The nested liner assembly is for use with trash receptacles and is dimensioned for the particular trash receptacle it is used with. U.S. patent application Ser. No. 15/421,562 filed Feb. 1, 2017, is hereby incorporated herein in its entirety.

In general, placing a liner inside a trash receptacle facilitates trash or refuse collection. Liners, which may be plastic bags, may be used to keep the interior surface of a trash receptacle clean and free of the miscellaneous streaks, stains, and malodors that tend to accompany trash stored for disposal. The liners may also facilitate removal of the collected trash from the trash receptacle as a user may lift a trash-filled liner out of the trash receptacle and insert a new liner. Still, even with the use of liners, trash collection may be time-consuming. The action of removing a trash-filled liner and introducing a new liner to the trash receptacle may take quite a bit of time especially when there are several trash receptacles to be emptied and new liners to be inserted. Trash removal may be even more cumbersome with trash receptacles having lids, particularly hingedly attached (or hinged) lids. Liners for use in trash receptacles without hinged lids may not be as appropriate for use with hinged-lid trash receptacles because of the hinge between the lid and the rim of the trash receptacle. Placing an edge of a liner over the hinge may obstruct hinge operation. A nested liner assembly of the present disclosure provides an alternative way to collect trash from receptacles, particularly from hinged-lid trash receptacles. The nested liner assembly may comprise an insert operable (e.g., 104, FIG. 1) that is affixed at a rim of a trash receptacle, a lifter (e.g., 108, FIG. 1) that is removably inserted into the insert operable, and a plurality of liners (e.g., 120, FIG. 1) which are removably attached to the lifter and extend into the interior of the trash receptacle. The foregoing components of the nested liner assembly and their accompanying features are described in further detail below.

Figure 1:
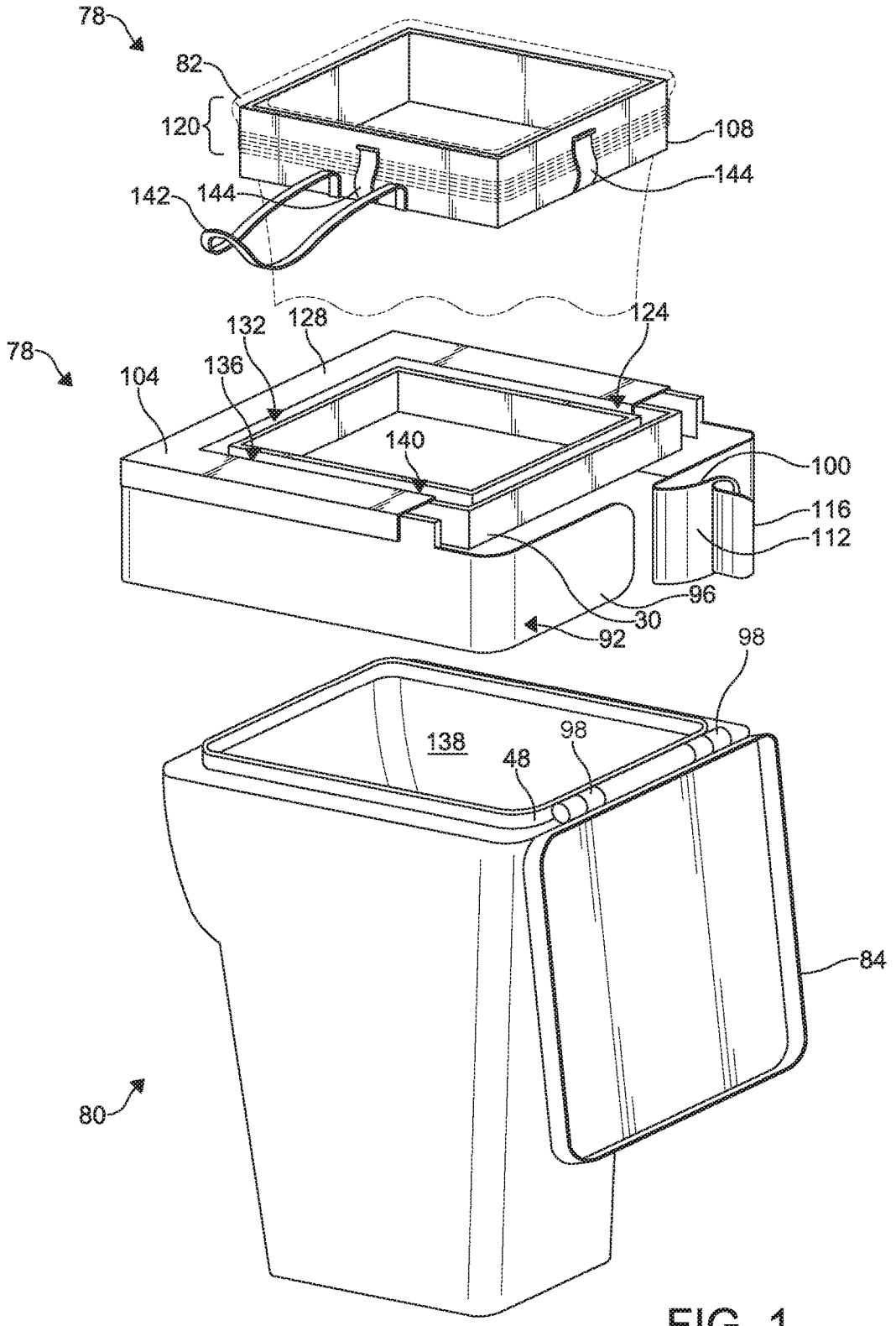
FIG. 1 is an exploded view of a nested trash liner assembly and a large, wheeled, trash receptacle with a lid according to an aspect of the disclosure.

In ordinary use of a trash receptacle with the nested liner assembly, the insert is affixed to the rim of a trash receptacle and may be secured, where needed, behind the hinge. The lifter, having a plurality of liners attached thereto, is placed within the insert so that the liners may extend inside the trash receptacle. Trash is collected in an innermost liner of the assembly, and once full, the innermost liner may be removed leaving a next liner ready and available for filling, continuing in the same manner until the liners are filled and removed in sequence. That is, removal of an innermost liner from the plurality of liners leaves a remainder of the liners, including the next innermost liner, ready for use in the trash receptacle. FIG. 1 shows the relationship of a hinged-lid trash receptacle 80 and a nested liner assembly 78 including its insert 104, lifter 108, and plurality of liners 120. FIG. 1 presents a large, wheeled trash receptacle 80 which has a lid 84 held in place by two hinges 98. The trash receptacle 80 may be any shape, such as rectangular with a rectangular opening as shown in FIG. 1, or any shape of opening, such as oval, square, or round. As described, the nested liner assembly 78 has an insert operable to be inserted into the trash receptacle 80. The insert 104 is placed over a rim 48 of trash receptacle 80.

In some aspects, the insert 104 may comprise an inner portion 124 and a rim grip 128. The inner portion 124 of the insert 104 may be coupled to the rim grip 128 that attaches to the rim 48 of the trash receptacle. The rim grip 128 may thus support the weight of the inner portion 124 so that the inner portion 124 extends into an interior 138 of the trash receptacle.

As shown in FIG. 1, the rim grip 128 may extend across the rim of the trash receptacle 80 with the exception of a portion of the rim 48 where the hinges 98 are located. The rim grip 128 may be a flexible material to allow the rim grip to extend over the rim 48 of the trash receptacle. In certain examples, the rim grip may comprise a plurality of hooks that are configured to extend over the rim of the trash receptacle. For example, the rim grip 128 may comprise two hooks. In yet further examples, the rim grip may refer to a section of the insert rather than as a distinct portion connecting the outer portion and inner portion of the insert. In those examples, the insert may comprise a single or unitary body having an inner portion, a rim grip portion, and an outer portion.

Referring again to FIG. 1, the inner portion 124 of the insert 104, disposed within the interior 138 of the trash receptacle 80, further defines a channel 140. More specifically, the inner portion 124 of the insert 104 has an inner wall 136 and an outer wall 132 that form the channel 140 therein. This channel is configured to receive the lifter as described above and which is described in greater detail below.

In some aspects, and as shown in FIG. 1, the insert 104 may comprise an outer portion. The outer portion 92 may comprise a material that encircles the trash receptacle. In addition to the rim grip, the outer portion 92 may further secure the insert 104 to the hinged-lid trash receptacle. The lid 84 is shown in an open position. The outer portion 92 may be connected with the inner portion 124 via the rim grip 128 so that the outer portion 92 is disposed adjacent an exterior surface of the trash receptacle 80. The outer portion 92 is not necessarily continuous as it encircles the trash receptacle 80. Instead, the outer portion 92 may have opposing, overlapping ends, i.e., a first end 96 and a second end 100, that may be connected with one another. Connecting the first end 96 and the second end 100 further secures the insert 104 to the trash receptacle 80. The outer portion 92 may have at least a first end 96 and a second end 100 that are configured to enclose or secure the outer portion 92 around the exterior surface of the trash receptacle 80. Generally, the outer portion 92 encloses an upper area of the trash receptacle 80, such as, towards its rim 48. When the trash receptacle 80 has the insert 104 disposed therein, overlapping first end 96 and second end 100 may be connected with one another. In one example, the first end 96 and second end 100 overlap and may be held together with an adhesive and release paper system to secure the outer portion of the insert to the trash receptacle 80. An adhesive 112 may be used on one of the ends, such as the second end 100, and a release substrate 116 (such as paper) is disposed adjacent the adhesive so that a user is allowed to detach the release paper 116. The release paper 116 is removed prior to the first end 96 and the second end 100 being overlapped and pressed together with sufficient force so that insert 104 remains in place for placement of insert 104 and the use of the innermost liner 82 for receiving trash. The second end 100, which is the adhesive end in this example, may be joined to the first end 96 via the adhesive 112 when the insert 104 is placed within the trash receptacle 80. In a further example, the first end 96 and the second end 100 may include mated Velcro™ brand hook and loop fastener portions so that the ends 96, 100 may be repeatedly opened and closed about the trash receptacle 80.

As provided above, the nested liner assembly includes a lifter 108 that is dimensioned to fit into the channel 140 of the inner portion 124 of the insert 104. A plurality of liners 120 are removably attached to the insert. Removably may refer to the ability to add or remove liners of the plurality of liners 120 from the assembly. The lifter 108 is dimensioned to fit within the channel 140 of the inner portion 124 of the insert 104 so that the lifter 108 is also disposed within the trash receptacle 80. The lifter 108 having the attached plurality of liners 120 may be disposed within the channel 140 of the insert 104 so that the plurality of liners 120 may extend into the interior 138 of the trash receptacle 80. The nested liner assembly may include one more lift straps 142 attached to the lifter 108. The lift straps 142 are configured to allow a user to remove the lifter 108 from the interior 138 of the trash receptacle. In some examples, the lift straps 142 may be connected with the bottom end of the lifter 108.

One or more fasteners 144, including for example, spring fingers and/or non-spring loaded couplers, are disposed at the lifter 108 to removably hold, or attach, the plurality of liners 120 to the lifter 108. The number of fasteners 144 in the nested liner assembly may depend upon the shape of the opening of the trash assembly in which the nested liner assembly is disposed. In some examples, the nested liner assembly may include about four fasteners to secure the plurality of liners to the lifter. The lift straps 142 are operable to allow a user to lift the lifter 108 and plurality of liners 120 thereby removing the lifter 108 from the channel 140 and the plurality of liners 120 from the interior 138 of the trash receptacle 80. The lift straps 142 may comprise a material that is sufficiently sturdy or resilient to withstand the force of lifting the lifter 108, or the lifter 108 and plurality of liners 120 as well as any accompanying trash, from the trash receptacle 80. In one example, the lift straps 142 comprise a plastic film.

Figure 2:
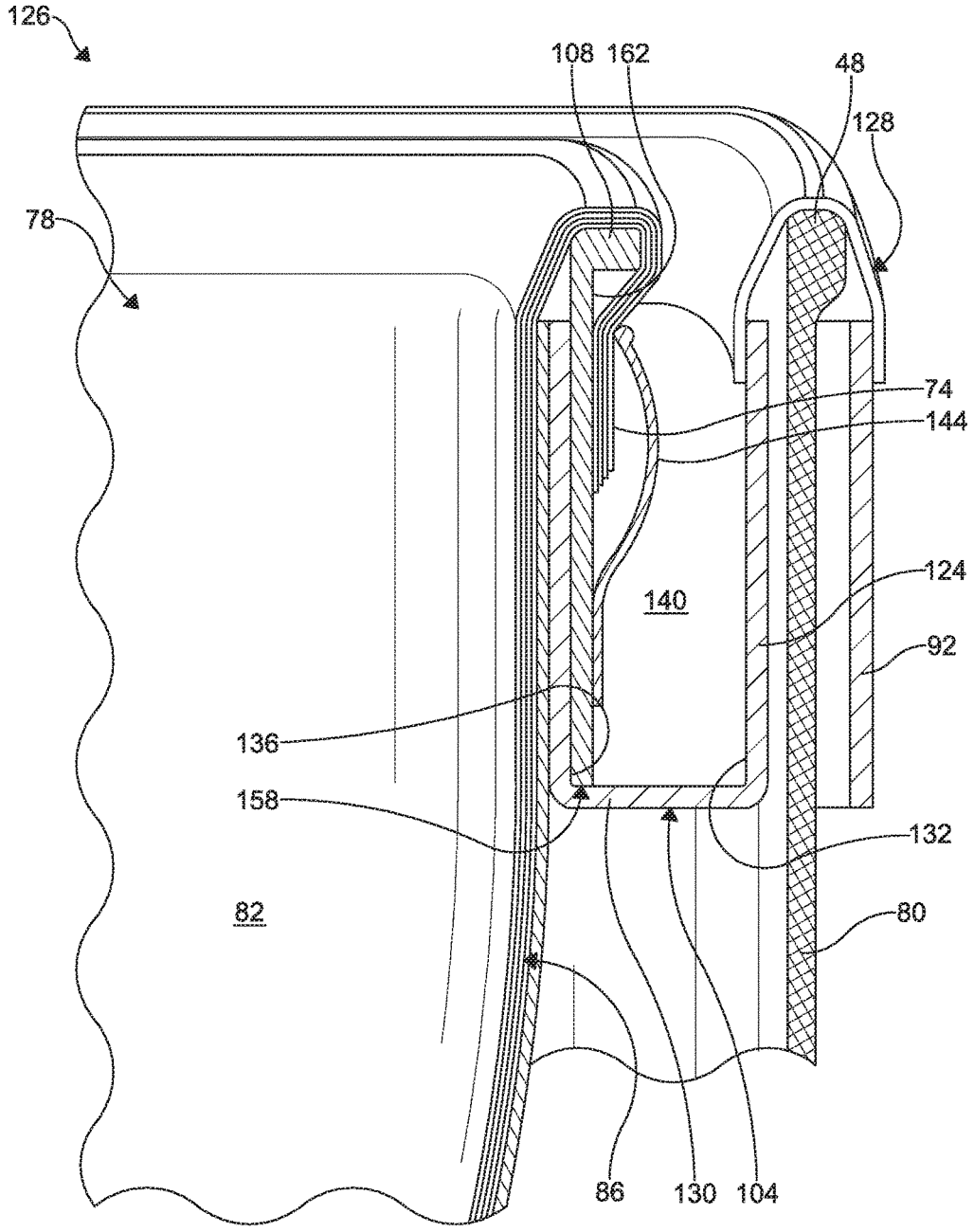
FIG. 2 is a detailed, cross-sectional view of the trash receptacle with the present nested liner assembly thereon, according to an aspect of the disclosure.

FIG. 2 provides a cross-sectional view in greater detail of the nested liner assembly 78 within a trash receptacle 80. As shown, the outer portion 92 of the insert 104 may be disposed at an exterior surface of the trash receptacle. The inner portion 124 of the insert 104 is shown having an inner wall 136, an outer wall 132, and a bottom wall 130 defining a channel there between 140 in FIG. 2. The outer portion 92 of insert 104 is connected with the inner portion 124 of insert 104 by the rim grip 128, shown as a belt, as described above.

The rim grip 128 may be made of a material that is sufficiently resilient and pliable to extend over the rim 48. As an example, the rim grip 128 may extend from the inner wall 136 to the rim 48 of the trash receptacle 80. The rim grip 128 may connect the outer portion 92 to the inner portion 124 of the insert 104. The rim grip 128 may extend from the rim 48 of the trash receptacle 80 so that, when the insert 104 is disposed within the trash receptacle 80, the outer wall 132 of the inner portion 124 is adjacent the trash receptacle 80 and the inner wall 136 of the inner portion 124 is towards the interior 138 of the trash receptacle 80. Exemplary materials for the rim grip 128 may include a plasticized or plastic-coated fabric or material, a vinyl material, or other material that may conform to rim 48 and may hold outer portion 92 to inner portion 124 securely. In further examples, the rim grip 128 may comprise cardboard that conforms to the rim 48 of the trash receptacle 80. The rim grip 128 may comprise a prefabricated cardboard configured to fit the rim 48.

The outer wall 132 and the inner wall 136 define a channel 140 there between. Channel 140 may receive the lifter 108 which is secured to the plurality of liners 120, via fasteners 144, e.g., spring fingers. Thus, insert 104 may hold the lifter 108 in place with the plurality of liners 120. The lifter 108 may be an annular ring or band that has a lower end 158 which is inserted into channel 140 between inner wall 136 and outer wall 132. The annular ring or band shape of the lifter 108 allows for the lifter 108 to fit into the channel 140 of the insert 104. The lifter 108 may comprise a sturdy material, which may be readily disposed of, for example, cardboard or another disposable. In some examples, the lifter 108 may be sufficiently reusable, that is, the lifter 108 may be used with one plurality of liners 120 after another. Thus, the lifter 108 may comprise a sufficiently sturdy material configured for repeated reuse such as metal, metal alloys, and plastic polymers, for example and not to be limiting.

The lifter 108 positions the plurality of liners 120 adjacent the insert 104. The plurality of liners 120 includes an outermost liner 86, which may be thicker than remaining liners of the plurality of liners 120. The fastener (e.g., spring finger, adhesive, or the like) 144 is configured to hold or position the plurality of liners 120 in place as each liner is filled with trash and then removed. Each liner of the plurality of liners 120 may have an edge 74 that defines its opening and frames its liner body 126. Edges 74 may be aligned and disposed between the fastener 144 and the lifter. The edges 74 may be disposed adjacent an exterior surface 162 of lifter 108 where fasteners 144 hold the liners 120 in place on lifter 108 by affixing the edges 74 to the exterior surface 162 of the lifter. The liners 120 attached to the lifter are situated so that the liner body 126 may extend into the interior of the trash receptacle 80.

The lifter 108 may include lift straps 142. Accordingly, the lift straps 142 may be used to lift lifter 108 and plurality of liners 120 out of insert 104 and from trash receptacle 80. Insert 104 keeps lifter 108 in position near the rim 48 or opening of trash receptacle 80 so that the plurality of liners 120 may extend into the interior of the trash receptacle 80. That is, in many examples, insert 104 is disposed within the trash receptacle 80 near the rim 48, rather than farther down into the interior 138 of the trash receptacle 80.

Figure 3:
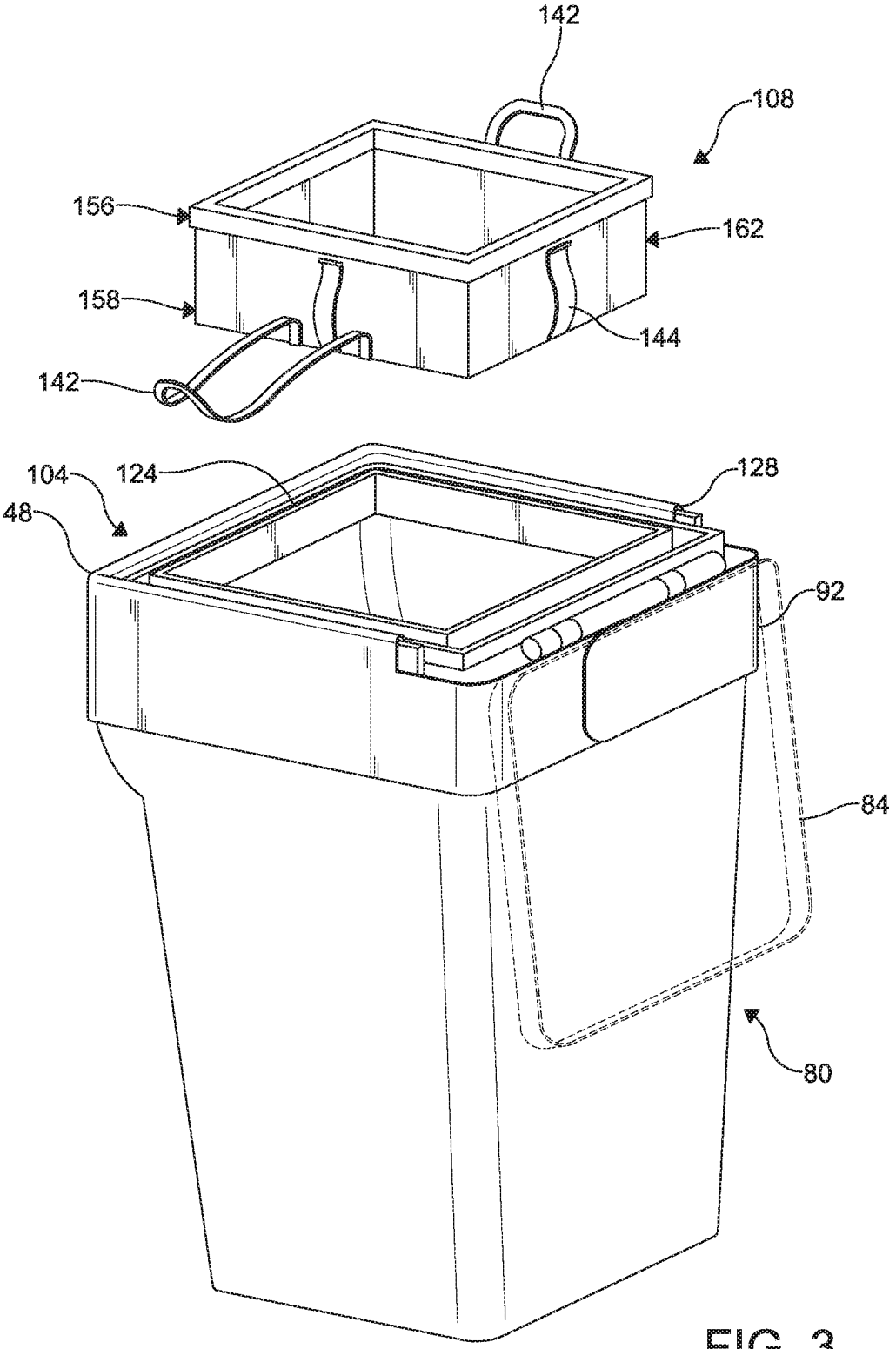
FIG. 3 is a perspective view of a combined insert and a lifter, according to an aspect of the disclosure.

FIG. 3 presents further detail of the lifter in the nested liner assembly. As provided herein, the lifter 108 may comprise an open ended annular body having an interior surface 151 and an exterior surface 162 and configured to fit at a rim 48 of a trash receptacle 80 as also presented in FIG. 1. The lid 84 is shown in an open position and presented in phantom lines so that closure of the outer portion 92 of the insert 104 may be seen. Also presented in FIG. 3 is an insert 104 placed over a rim 48 of trash receptacle 80. Insert 104 has an outer portion 92 and an inner portion 124 joined by a rim grip 128, such as a belt. The lifter 108 may have an upper end, or a lip 156 and a bottom end or bottom opening 158. The lifter 108 may have one or more lift straps (or handles) 142 at an exterior surface 162 of the lifter 108. One or more fasteners 144, (e.g., a spring finger described herein) may be disposed at the exterior surface 162 of the lifter 108. The lifter 108 may be comprised of a sturdy or resilient material. In various examples, the lifter 108 may comprise disposable materials. In some examples, the lifter may be anchored to the insert so as to keep respective sections of the nested liner assembly together. As shown in FIG. 3, the lifter 108 may be anchored or connected to the inner portion of the insert via one or more cords or strings 168. The strings or cords 168 may be tucked into the channel 140 adjacent the lifter when the lifter is disposed within the insert. The strings or cords 168 may comprise fishing line.

Figure 4:
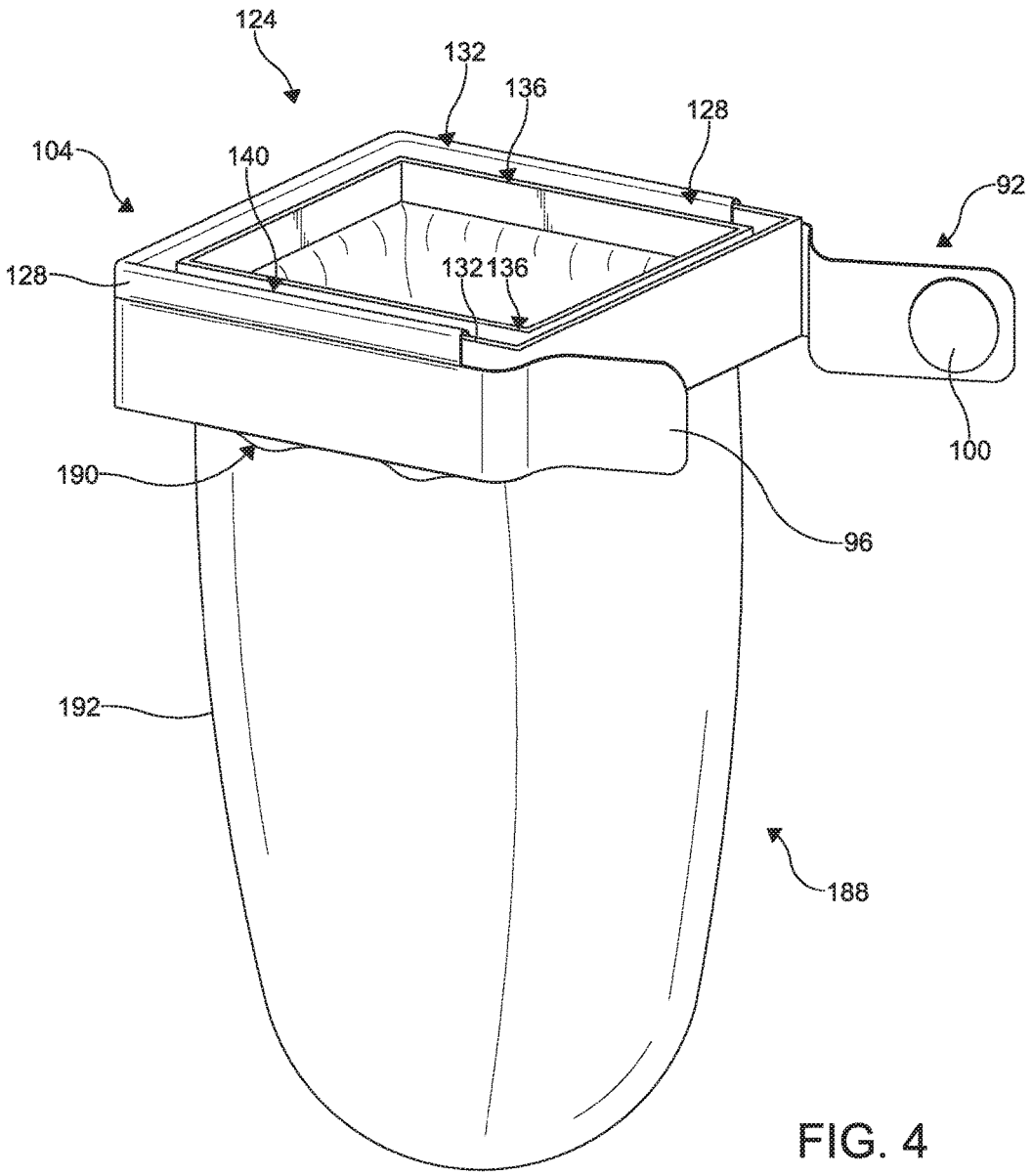
FIG. 4 is a perspective view of an insert and its accompanying master liner, according to an aspect of the disclosure.
Figure 5:
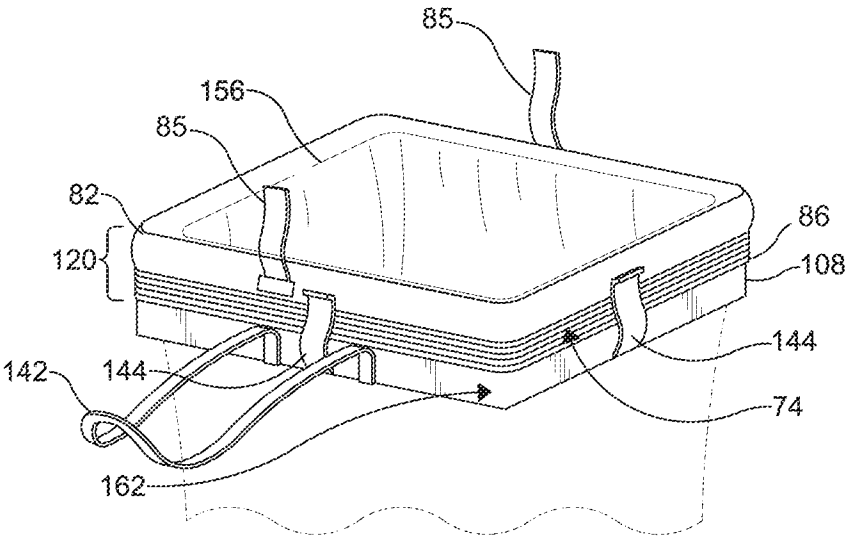
FIG. 5 is a view of the plurality of liners in the nested liner assembly.

FIG. 4 presents a detailed view of the insert. In some examples the insert 104 may comprise a master liner 188 attached thereto. The master liner 188 may protect the interior of the trash receptacle from miscellaneous spills or odors that may escape the plurality of liners when the nested liner assembly is in use. As shown in FIG. 5, the insert 104 may comprise the inner portion 124 and outer portion 92, which may be connected by a rim grip 128. The inner wall 136, outer wall 132, and bottom wall 130 define a channel 140 configured to receive the lifter (108, not shown) as described above. Much like a liner of the plurality of liners (not shown), the master liner 188 may comprise a master liner edge 190 that defines a master liner body 192. The master liner edge 190 of the master liner 188 may be attached to the bottom wall 130 (not shown) of the insert 104 in a way so that the master liner may line the interior of the trash receptacle. In various examples, the master liner 188 may be removably attached to the insert 104. That is, the master liner 188 may be attached to the bottom wall of the insert 104 via an attachment mechanism that is re-usable. For example, the master liner may be attached to the bottom wall of the insert via mated Velcro™ brand hook and loop fastener portions, adhesive tape, or another appropriate fastener at the bottom wall and at the master liner edge 190. In certain examples, mated Velcro™ brand hook and loop fastener portions may allow for the release of trapped gases when the insert with the master liner attached thereto are inserted into a trash receptacle. Mated Velcro™ brand hook and loop fastener portions generally do not provide a vacuum seal between the master liner 188 and the inner portion 124 of the insert 104 thereby allowing the nested liner assembly to breath when the insert is disposed within a trash receptacle.

The master liner 188 may be comprised of a sufficiently resilient, but still pliable, material to resist damage or tearing from manipulation during removal and/or insertion (or re-insertion) into a trash receptacle. For this reason, and among others, the master liner 188 may have a greater thickness than a liner of the plurality of liners. The master liner 188 may comprise a heavier weight material than a liner of the plurality of liners, up to about 10 times the thickness of a liner of the plurality of liners where the plurality of liners have a thickness of about 5 to about 17 Mil, or from about 4 to about 15 microns. For example, the master liner 188 may comprise a 5 Mil gauge plastic film.

Referring now to FIG. 5 there is shown a detailed view of the plurality of liners 120 attached to the lifter 108. A plurality of liners 120 may be inserted into the fasteners 144 of the lifter 108 so that the liners 120 extend from the exterior surface 162 of the lifter 108, over the lip of the lifter 108 as the edges 74 of the liners extend into the fasteners 144 to hold the liners in place, shown in FIG. 5. In some examples, the plurality of liners 120 may have a row of perforations towards the edge. These perforations may facilitate removal of a liner from the remaining liners in the nested liner assembly. For example, liners may have perforations parallel or almost parallel to the edges of the liners along a distance that is between an edge 74 of the liner and a portion of the liner that extends over the lip 156 of the loading device and into the interior of the trash receptacle.

A plurality of liners 120 may comprise a set of liners in a nested configuration. The set may contain a plurality of liners, such as, 10 or more, wherein a first or innermost liner is inside a next or subsequent liner and so on to an outermost liner with the remainder of the liners arranged between them, one inside another, running from the innermost liner to the outermost liner. The nested liner assembly may hold any number of liners, which may range from 1 to 100 or more liners. The number of liners may be based on the size of a given trash receptacle or the make-up of the liner (e.g., thickness of liner material). The number of liners may be a large number depending on the thickness of the liner. Liners as described herein may be comparable to what are commonly known as trash bags. These bags may be formed from a number of different types of resins, and are commonly formed from polyethylene resins including low density polyethylene (LDPE), linear low density polyethylene (LLDPE), high molecular weight-high density polyethylene (HMW-HDPE), higher alpha olefin resin (HAO)—usually hexane or octane based, butane, hexane, or octene, among others. Trash bag may be measured according to whether the thickness is low linear density (LLD) or high density (HD). LLD bags are measured in Mil, where one Mil is equal to one thousandth of an inch with 0.7 Mil being the thinnest and 4.0 Mil being the thickest. A lower Mil LLD trash bag may be useful for lighter or smaller trash, while a higher Mil LLD bag may be used for larger, heavier, or sharper trash. HD trash bags tend to be lighter and thinner than LLD bags and more susceptible to puncturing, although they can carry heavier loads than LLD bags. HD trash bags are measured in microns (micrometers, μm) (MIC) which are about one fifth of a Mil where 6 MIC are the thinnest and 17 MIC are the thickest. Liners of the plurality of liners of the present disclosure may be trash bags or other bags formed from polyethylene resins and represent varying sizes or thicknesses according to LLD and HD.

Nested as used herein describes a configuration of the plurality of liners such that each liner of the plurality of liners is inside a next liner, with the exception of an outermost liner also presented in FIG. 5. The plurality of liners 120 may be attached to the lifter 108 via one or more fasteners 144. In an example, a first or innermost liner 82 may be disposed within an interior of a second liner; the first and second liner, within an interior of a third liner; the first, second, and third liner, within an interior of a fourth liner; and so on, until an outermost liner 86. The outermost liner 86 may refer to a liner of the plurality of liners that is configured to be disposed adjacent an interior surface of a trash receptacle. In further examples, the outermost liner 86 may refer to a liner of the plurality of liners that is disposed adjacent the master liner attached to the insert and depicted in FIG. 4. As shown in FIG. 5, the outermost liner 86 abuts at least a surface of the lifter 108.

As described herein, the outermost liner 86 of the plurality of liners 120 may be a thicker liner, that is, the outermost liner may have a thickness that is greater than a thickness of remaining liners of the plurality of liners 120. A thicker outermost liner 86 may be useful because this liner is in contact with the lifter and with the interior surface of the trash receptacle or the master liner of the insert. Having a greater thickness for the outermost liner 86 may also be useful because the outermost liner 86 will be within the trash receptacle for a longer duration of than the remaining liners of the plurality of liners 120. Thus the outermost liner 86 may be thicker so that it is more durable during manipulation (e.g., filling of liners, removal of filled liners) of the nested liner assembly. As an example, and not to be limiting, an outermost liner 86 may comprise a higher mil LLD bag.

Figure 6:
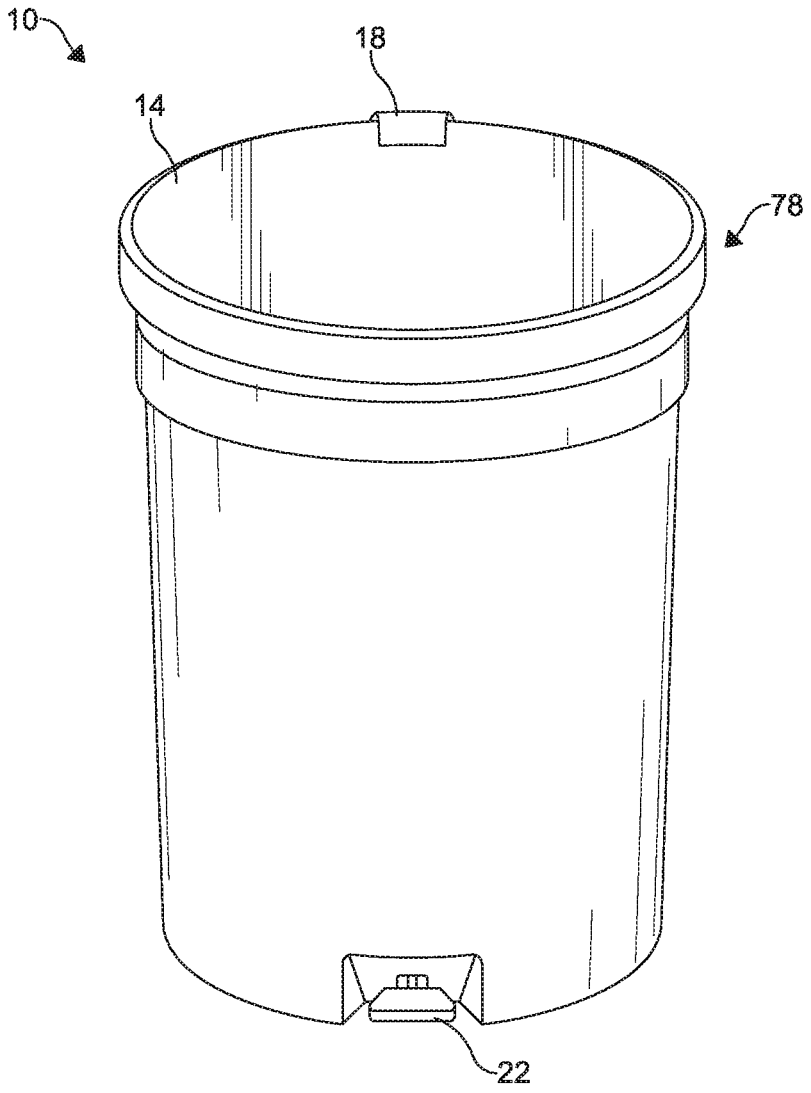
FIG. 6 is a perspective view of a nested liner assembly in a closed, cylindrical trash receptacle, according to an aspect of the disclosure.
Figure 7:
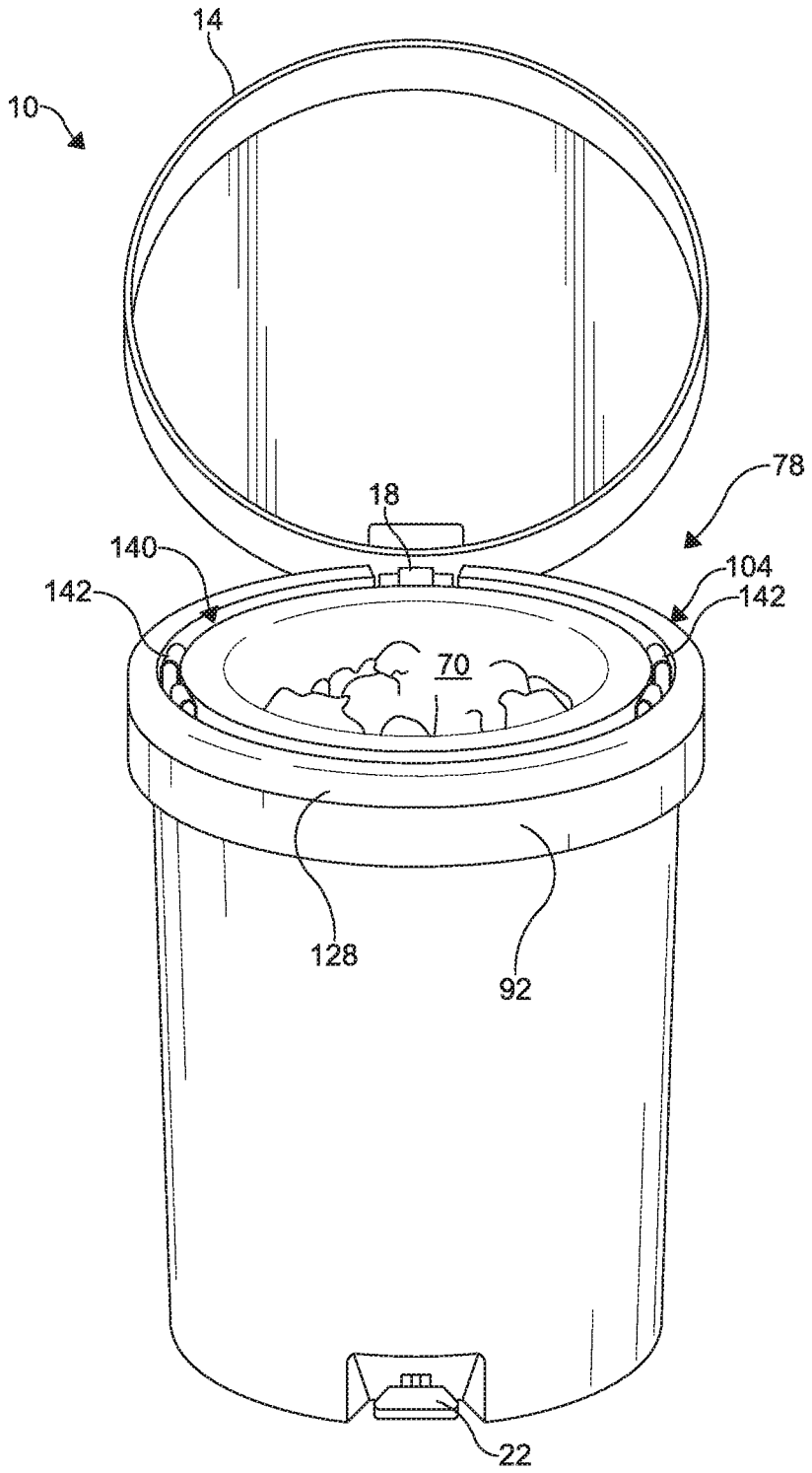
FIG. 7 is a perspective view of the nested liner assembly of FIG. 6 with the lid in an open position, according to an aspect of the disclosure.
Figure 8:
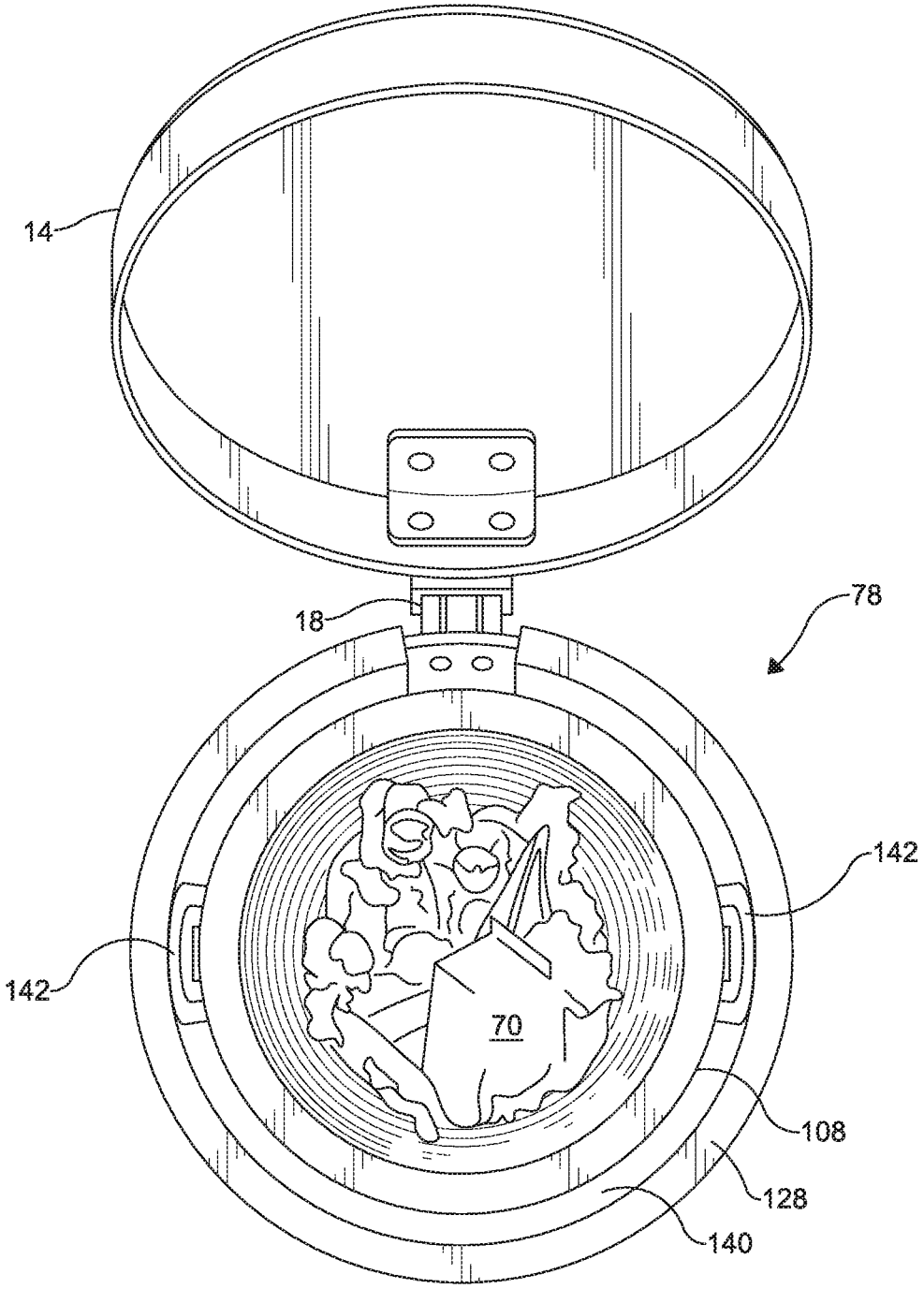
FIG. 8 is a top view of the nested liner assembly in a trash receptacle.

The nested liner assembly of the present disclosure is readily useful in a number of types of trash receptacles including those of varying shapes. FIGS. 6-8 show top views for the nested liner assembly in a cylindrical trash receptacle having a lid. According to these aspects, the nested liner may comprise an insert, having an inner portion and an outer portion, and a lifter having a plurality of liners in a nested configuration. Trash receptacle 10 has a lid 14 that is attached to trash receptacle 10 by a hinge 18. Lid 14 may be pivoted from a closed position as shown in FIG. 6 to an open position, as shown in FIGS. 7 and 8, at hinge 18. Some trash receptacles 10 may have an opening operable, such as a foot control 22, which may be operated by a user's foot to raise lid 14 to an open position. The foot control 22 may be operated by levers inside trash receptacle in a manner that is well-known.

Inside trash receptacle 10 is a nested liner assembly 78, part of which may be seen in FIGS. 6-7, and all of which may be seen in FIG. 8. With lid 14 opened, many of the features of nested liner assembly 78 may be seen, as shown in FIGS. 7 and 8, including a pair of lift straps 142, as well as trash 70. The inner portion 124 of the insert 104 is placed at a rim 48 of trash receptacle 10. Insert 104 has an outer portion 92 and an inner portion 124 held together by a rim grip 128. Channel 140 may receive the lifter 108 which holds plurality of liners 120, assisted by fasteners 144. Thus, insert 104 may support lifter 108. Lifter 108 may comprise an annular ring or band that has a lower end 158 inserted into channel 140 between inner wall 136 and outer wall 132.

Referring again to FIG. 1, the disclosed nested liner assembly 78 is placed on trash receptacle 80 by opening lid 84 and placing insert 104 at the rim of trash receptacle 80. The first end 96 and the second end 100 of the outer portion 92 may be secured around the trash receptacle 80. The plurality of liners 120 may be attached to lifter 108 by pulling the liners through lifter 108 and turning the plurality of liners 120 over a top edge of lifter 108. Fastener 144 secures the plurality of liners 120 to the lifter 108. The plurality of liners 120 are then lowered into the interior 138 of trash receptacle 80 and the lifter 108 placed in the channel 140 between the inner wall 136 and outer wall 132 of insert 104. Trash may be deposited into the plurality of liners 120. After the innermost liner 82 is filled with trash, innermost liner 82 may be separated from the remaining liners of the plurality of liners 120. The innermost liner 82, filled with trash, may then be lifted up and out of the trash receptacle. The lifting of the inner most liner may be achieved by using the pull tabs 85 (as in FIGS. 5 and 11) of the ribbon pull assembly. The opening of the trash-filled liner may be sealed in any convenient manner.

Figure 9:
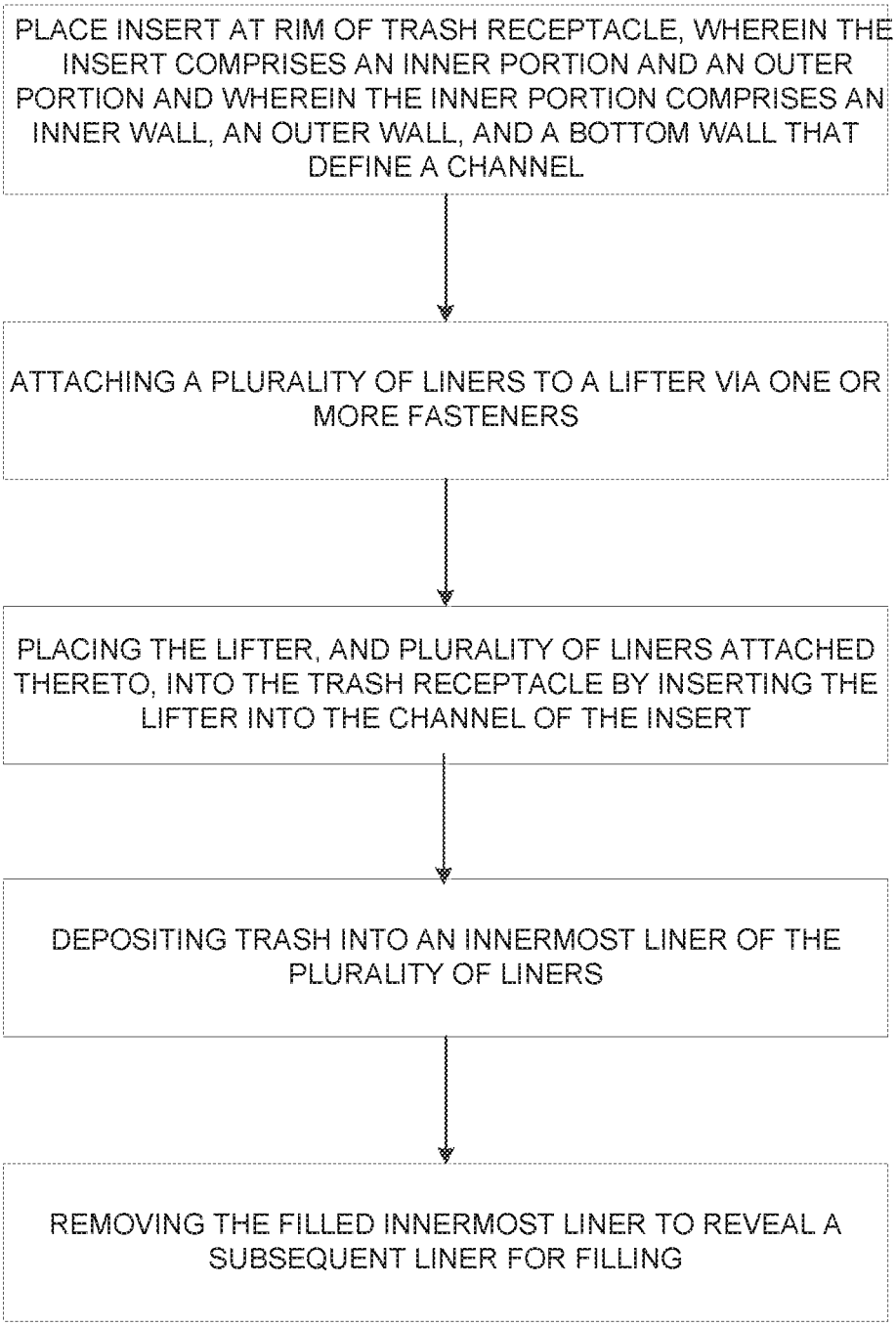
FIG. 9 is a scheme depicting a method of use for the nested liner assembly, according to an aspect of the disclosure.

FIG. 9 provides an exemplary diagram of a method for use of the disclosed nested liner assembly. At 900, the insert may be placed at the rim of the trash receptacle. The insert may comprise an inner portion and an outer portion wherein the inner portion comprises an inner wall, an outer wall, and a bottom wall that define a channel. At 902, a plurality of liners may be attached to a lifter via one or more fasteners. The lifter, with the plurality of liners attached thereto, may be placed into the trash receptacle by inserting the lifter into the channel of the insert at step 904. At step 906, trash may be deposited into an innermost liner of the plurality of liners. At step 908, the filled innermost liner may be removed to reveal a subsequent liner for filling.

The nested liner assembly of the present disclosure is configured for ease of use by any given user. For example, the ribbon pull assembly or the perforations along the liner edges allows for easier removal of a desired liner. Further, the lifter and insert may be comprised of cardboard or other similarly disposable materials. The lifter may be of a sufficiently durable material so that the lifter may be used with several inserts as they are replaced and re-filled with a new plurality of liners.

The components of the nested liner assembly may comprise a number of materials that are sufficiently sturdy or durable to withstand use of a given trash receptacle. In one aspect of the nested liner assembly, the insert and the lifter may be made of cardboard. In others, the lifter may comprise metal, metal alloys, or polymer resins. Liners as described herein may comprise materials suitable as use for refuse and trash. In various examples, the liner is made of a plastic film such as LDPE.

In some examples, the nested liner assembly may comprise a single insert component for use in a receptacle. Single insert may describe the nested liner assembly wherein the lifter is integrated into the insert structure, rather than being a separate structure that can readily be removed. The single insert may be described as "pre-loaded" because components of the nested liner assembly, for example the plurality of liners, are already disposed therein. The single insert may be particularly useful for lidded trash receptacles having a smaller diameter opening, for example less than 12 inches diameter, but is useful in any size trash receptacle. Because of the smaller diameter for receiving trash, a smaller trash receptacle may have less space for the nested liner assembly having separate lifter and insert components. A small trash receptacle as referred to herein may include a receptacle having an opening with a diameter less than about 12 inches to about 15 inches. Thus, the nested liner assembly may be useful in lidded trash receptacles of a variety of shapes and sizes.

Figure 10B:
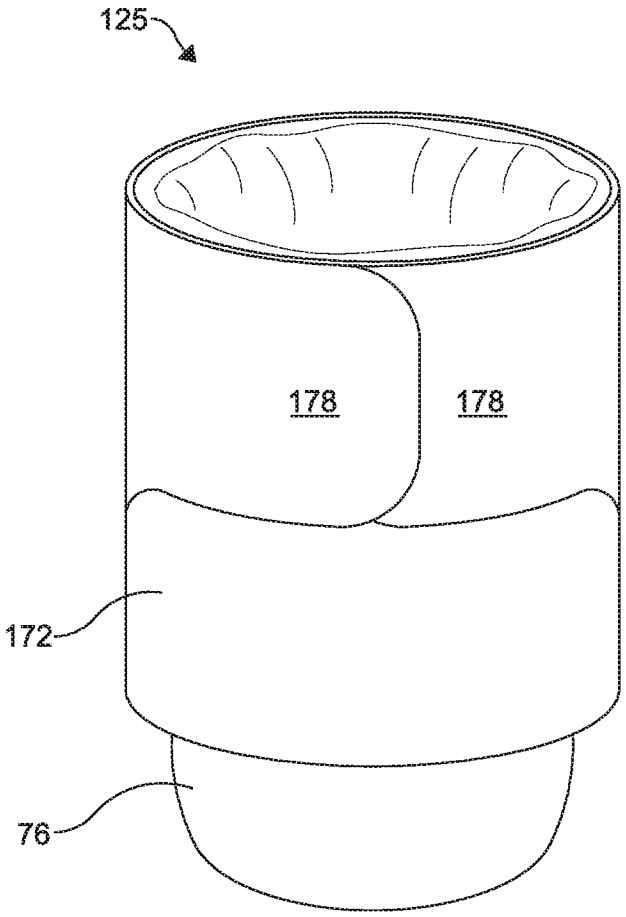
FIGS. 10A and 10B are views of a pre-loaded (or single insert) nested liner assembly.
Figure 10A:
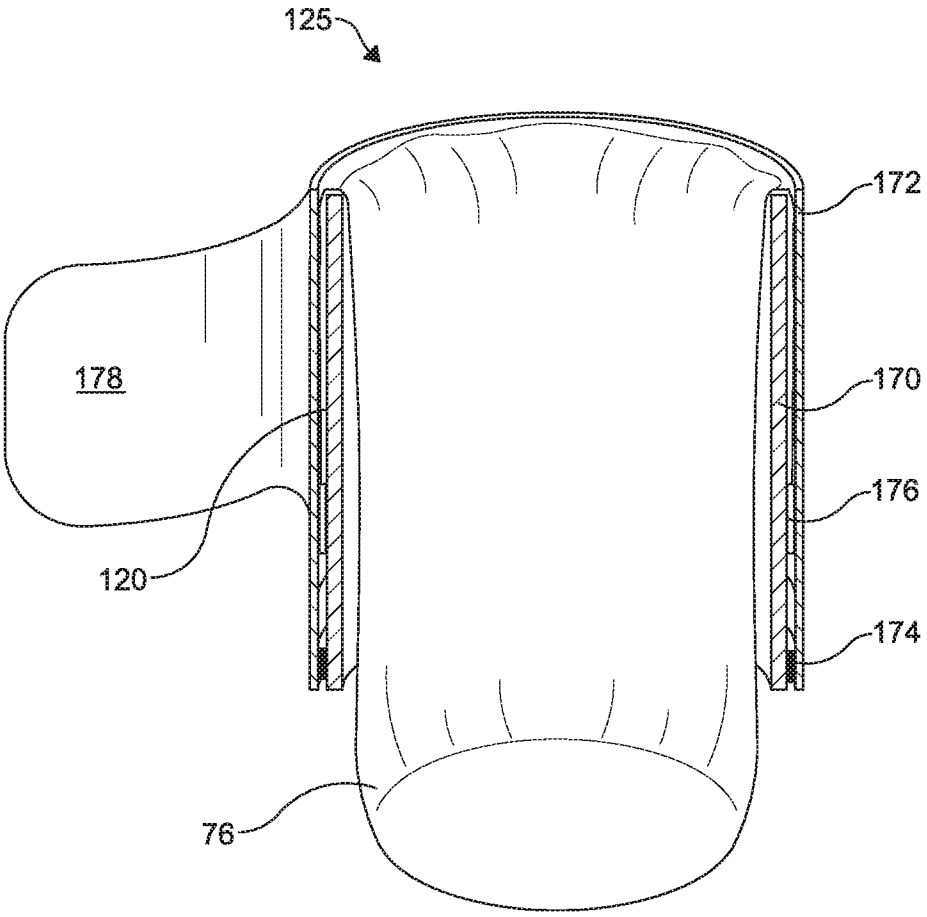

As provided herein, the nested liner assembly may comprise a single insert system as shown in FIGS. 10A and 10B. FIG. 10A presents a cross-section of the single insert. The single insert 125 for the smaller trash receptacle may comprise an inner body 170 and an outer body 172 joined as a single unit. The inner body 170 and the outer body 172 may be concentric, annular hollow bodies that are open ended. That is, the inner body 170 may define a hollow interior and have an interior surface and an exterior surface. The outer body 172 may similarly define a hollow interior and have an interior surface and an exterior surface. By having concentric annular bodies, the inner body 170 may be so sized to be disposed within the outer body 172. Ends of the inner body 170 and outer body 172 are joined by a connector ring 174. The connector ring 174 is a similarly annular body that is disposed between the inner body 170 and outer body 172. The connector ring 174 may work to seal the inner body 170 and outer body 172 together and space them apart so that there is a space between inner body 170 and outer body 172 to accommodate a plurality of liners 120.

The plurality of liners 120 plurality of liners may extend through the interior of the inner body 170. The liner body 76 can be seen in FIGS. 10 A and 10 B extending beyond the inner body 170 and outer body 172. The pre-loaded or single insert nested liner assembly for a trash receptacle may include a ribbon pull assembly described herein.

Edges 74 of the liners 120 may extend over an end of the inner body 170 to the exterior surface of the inner body 170. A collar 176 may affix the edges 74 to the inner body 170. The collar 176 may be a flat or somewhat flat annular band that keeps the edges adjacent the inner body 170. The outer body 172 thus encloses the inner body 170 with the plurality of liners 120, connector 174, and collar 176 disposed there between. The single insert may further comprise an outer jacket 178, which is configured to the outer body 172 and functions as the outer portion 92 described above, to secure the single insert 125 to a trash receptacle. The outer jacket is shown open in FIG. 10 A and closed in FIG. 10B. The insert 125 may be disposed in a trash receptacle. In some examples, the insert fits snugly or securely into the trash receptacle.

Figure 11:
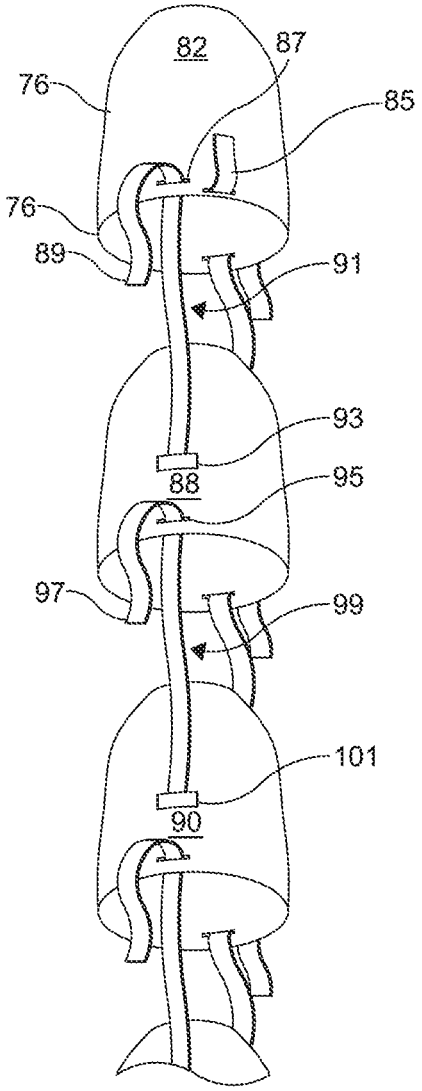
FIG. 11 is a view of the plurality of liners in the nested assembly for the pre-loaded insert.

As provided above, the pre-loaded (or single) insert configuration for the nested liner assembly may include the plurality of liners having a ribbon pull assembly as detailed in FIG. 11 showing three exemplary liners, an innermost liner 82, a second liner 88, and a third liner 90. The liners are presented inside out; that is, so that the connections between the liners are readily apparent. The innermost liner 82, second liner 88, and third liner 90, each have an edge 74 defining an opening into a liner body 76, FIG. 5B and at least a pair of slits or openings. The innermost liner 82 has a pair of openings 87 configured to receive a ribbon. Specifically, the openings 87 are configured to receive a first end 89 of each ribbon of a first ribbon pair 91. Each liner, except for the innermost liner 82, has a pair of ribbons attached at a position along its liner body to connect the liner to a preceding liner. Instead of ribbons attached to its liner body, the innermost liner 82 includes a pair of pull tabs 85 to aid in removal of the liner 82 from the trash receptacle once the liner 82 has been filled with trash. The openings 87 may be situated towards the liner edge 74, but leaving enough room that the liner edges 74 may be affixed to the fasteners 144 as in FIG. 5A. Each ribbon of the first ribbon pair 91 may have two ends, a first end 89 and a second end 93. The first ends 89 of the first ribbon pair 91 each pass through an opening 87 of the innermost liner 82 while the second ends 93 are attached or affixed to the liner body of the second liner 88. Thus, the innermost liner 82 of the plurality of liners 120 is coupled to the second liner 88. The remainder of the plurality of liners is similarly connected to one another. For example, the second liner 88 has at least a pair of openings 95 towards its liner edge 74. First ends 97 of a second ribbon pair 99 pass through the openings 95 of the second liner 88. Second ends 101 of the second ribbon pair are attached to the third liner 90. Such a ribbon pull assembly may join the liners throughout the entirety of the plurality of liners in the nested liner assembly. When the plurality of liners 120 are disposed within the nested liner assembly, first ends of the ribbon pairs may be tucked into the trash receptacle (not shown) and may not be visible during use.

The ribbon pull assembly may be used to aid in removal of a liner from the plurality of liners in the nested liner assembly. For example, when the innermost liner 82 has been filled with trash, a user may hold the pull tabs 82 of the innermost liner 82 and lift in an upward direction to cause the filled liner 82 to rise out of the nested liner assembly 78. As the innermost liner 82 is raised, the first ends of the first ribbon pair 91 pass through the openings 87 of the liner 82 until the liner 82 is free of the first ribbon pair 91 leaving the subsequent liner, i.e., the second liner 88, in place and available for filing. The remainder of liners in the plurality of liners may also include pull tabs 85. In the alternative, the remainder of liners may simply be lifted by pulling up at an interior surface of the liner towards the liner edge allowing liner to slide along the ribbons extending there through.

The plurality of liners 120 in the pre-loaded insert for a small trash receptacle may include a ribbon assembly shorter ribbon (than that configured for a larger trash receptacle) to accommodate the smaller size of the trash receptacle and longer pull tabs 85 so that the pull tabs 85 are readily accessible. The pull tabs for a smaller trash receptacle may be at least about 2-5 times longer than the pull tabs 85 of the liners in the assembly for a larger trash receptacle. The pre-loaded or single insert of the nested liner assembly for a trash receptacle may be formed from any suitably disposable material. In various examples, the insert may be formed from cardboard. Components of the pre-loaded insert may be formed from a coated material, or a material having a sealant film disposed there upon to prevent liquids and wet solids in the trash from soaking through. For example, the outer jacket may be formed from cardboard coated with, or having a finish of, a plastic film.

In various examples of the present disclosure, the nested liner assembly may be operable to fit into a trash receptacle, such as a wheeled trash receptacle, having a lid. There are a number of existing mechanisms for operating the lid of a trash receptacle. In one example, a hinge is used. Hinges may be disposed at the lid of the trash receptacle in any convenient manner, such as with fasteners, which may be screws, nuts and bolts, and adhesives. The hinged lid has at least an open position and a closed position. Hinge lidded trash receptacles are well known in the art. The nested liner assembly of the present disclosure may extend between the outside or exterior of the trash receptacle and the lid when the lid is in an open position.

Those skilled in the art of trash liner collection will appreciate various modifications and substitutions may be made to the foregoing description of aspects of the disclosure that fall within the spirit and scope of the claims that follow.

The present disclosure relates to at least the following aspects.

Aspect 1. A nested liner assembly, comprising: a plurality of liners, a liner of the plurality of liners being inside a next liner of the plurality of liners, the liner having an edge defining an opening into an interior of the liner, the plurality of liners including an innermost liner and an outermost liner; an insert operable to be inserted into a trash receptacle, the insert defining a channel and wherein the plurality of liners are configured to be removably attached to the insert; a lifter dimensioned to fit into the channel, the plurality of liners being removably attached to the insert; and at least one lift strap attached to the lifter and operable to lift the lifter from the channel of the insert.

Aspect 2. The nested liner assembly of aspect 1, wherein the insert has an inner wall and an outer wall, the outer wall being outside of a trash receptacle when the insert is placed on the trash receptacle and the inner wall is inside the trash receptacle.

Aspect 3. The nested liner assembly of aspect 2, wherein the edge of the liner is stretched over the inner wall of the insert.

Aspect 4. The nested liner assembly of aspect 3, wherein the at least one lift strap is two lift straps.

Aspect 5. The nested liner assembly of aspect 1, wherein the insert has an outer portion dimensioned to surround the trash receptacle.

Aspect 6. The nested liner assembly of aspect 5, wherein the outer portion has a first end and a second end.

Aspect 7. The nested liner assembly of aspect 6, wherein the first end and the second end overlap.

Aspect 8. The nested liner assembly of aspect 7, wherein the first end carries and adhesive.

Aspect 9. The nested liner assembly of aspect 8, wherein the first end has a release paper on the adhesive.

Aspect 10. The nested liner assembly of aspect 1, further wherein the innermost liner is a thicker liner relative to the other liners comprising the plurality of liners.

Aspect 11. The nested liner assembly of aspect 1, wherein the insert is operable to fit onto a wheeled trash receptacle.

Aspect 12. The nested liner assembly of aspect 11, wherein the wheeled trash receptacle has a lid with an open position and a closed position, and wherein the insert extends between the outside of the wheeled trash receptacle and the lid when the lid is in the open position.

Aspect 13. The nested liner assembly of aspect 1, wherein the insert comprises: an inner wall; an outer wall; and a belt connecting the inner wall to the outer wall.

Aspect 14. The nested liner assembly of aspect 13, wherein the trash receptacle has a rim with an inside, and an outside, and wherein the belt is made of a flexible material wherein the inner wall hangs on the inside of the rim and the outer wall hangs on the outside of the rim when the belt of the insert is positioned on the rim of the trash receptacle.

Aspect 15. The nested liner assembly of aspect 13, wherein the inner wall and the outer wall of the liner are made of cardboard.

Aspect 16. The nested liner assembly of aspect 1, wherein the lifter carries fasteners operable to hold the plurality of liners to the lifter.

Aspect 17. The nested liner assembly of aspect 1, wherein the lifter is made of cardboard.

Aspect 18. The nested liner assembly of aspect 1, wherein the liner is made of plastic film.

Aspect 19. The nested liner assembly of aspect 1, wherein the plurality of liners is at least 10 liners.

Aspect 20. A nested liner assembly, comprising: a plurality of liners, a liner of the plurality of liners being inside a next liner of the plurality of liners, the liner having an edge defining an opening into an interior of the liner, the plurality of liners including an innermost liner and an outermost liner; an insert to be inserted into a trash receptacle, the insert defining a channel, wherein the insert is coupled to tubing such that the tubing is configured to be disposed within an interior of the trash receptacle; a loading device configured to fit into the channel, wherein the plurality of liners is removably attached to the loading device; and at least one lift strap attached to the lifter and operable to lift the lifter from the channel of the insert.

Aspect 21. A nested liner assembly comprising: a plurality of liners, a liner of the plurality of liners being inside a next liner of the plurality of liners, the liner having an edge defining an opening into an interior of the liner, the plurality of liners including an innermost liner and an outermost liner; an insert to be inserted into a trash receptacle, the insert having an inner body and an outer body such that the plurality of liners is disposed between the inner body and the outer body.

Aspect 22. The nested liner assembly of aspect 21, wherein the plurality of liners are connected via a ribbon pull assembly.

Aspect 23. The nested liner assembly of aspect 21, wherein the plurality of liners are connected via one or more pairs of ribbons wherein each ribbon pair has ends affixed to a first liner and second ends passing through openings of a preceding liner in the plurality of liners.

Aspect 24 A ribbon pull assembly for a plurality of liners comprising a plurality of liners in a nested configuration wherein each liner of the plurality of liners has an edge defining an opening into a liner body and wherein each liner has at least a pair of openings; one or more ribbons affixed to each liner in sequence, wherein each of the one or more ribbons affixed to a liner passes through openings of a preceding liner of the plurality of liners.

Aspect 25. An insert configured to be inserted into a trash receptacle, the insert defining a channel, wherein the insert is coupled to a master liner such that the master liner is disposed within an interior of the trash receptacle, the insert comprising: an inner portion; and a rim grip.

Aspect 26. An annular body dimensioned to fit into a trash receptacle, the annular body defining a channel and comprising a plurality of fasteners configured to removably attach a plurality of liners to the annular body.

Aspect 27. An insert comprising: An outer shell disposed adjacent in inner shell wherein the outer shell and the inner shell are connected by a block; a plurality of liners, a liner of the plurality of liners being inside a next liner of the plurality of liners, the liner having an edge defining an opening into an interior of the liner, the plurality of liners including an innermost liner and an outermost liner, wherein the plurality of liners are disposed between the inner shell and the outer shell such that an interior of the plurality of liners extends beyond the inner and outer shells.

Definitions

It is to be understood that the terminology used herein is for the purpose of describing particular aspects only and is not intended to be limiting. As used in the specification and in the claims, the term "comprising" can include the embodiments "consisting of" and "consisting essentially of." Unless defined otherwise, all technical and scientific terms used herein have the same meaning as commonly understood by one of ordinary skill in the art to which this disclosure belongs. In this specification and in the claims which follow, reference will be made to a number of terms which shall be defined herein.

As used in the specification and the appended claims, the singular forms "a," "an" and "the" include plural equivalents unless the context clearly dictates otherwise. Thus, for example, reference to "a polycarbonate polymer" includes mixtures of two or more polycarbonate polymers.

As used herein, the term "combination" is inclusive of blends, mixtures, alloys, reaction products, and the like.

As used herein, the term "trash receptacle" may refer to a vessel configured to receive trash.

Ranges may be expressed herein as from one particular value to another particular value. When such a range is expressed, another aspect includes from the one particular value and/or to the other particular value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "about" and "at or about" mean that the amount or value in question may be the value designated some other value approximately or about the same. It is generally understood, as used herein, that it is the nominal value indicated ±5% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise. In addition, the use of the word "or" is generally used inclusively unless otherwise provided herein.

Disclosed are the components to be used to form the nested liner assembly disclosed herein. These and other materials are disclosed herein, and it is understood that when combinations, subsets, interactions, groups, etc. of these materials are disclosed that while specific reference of each various individual and collective combinations and permutation of these components cannot be explicitly disclosed, each is specifically contemplated and described herein. This concept applies to all aspects of this application including, but not limited to, steps in methods of using the assembly of the present disclosure. Thus, if there are a variety of additional steps that may be performed it is understood that each of these additional steps can be performed with any specific aspect or combination of aspects of the methods of the disclosure.

It will be apparent to those skilled in the art that various modifications and variations may be made in the present disclosure without departing from the scope or spirit of the disclosure. Other aspects of the disclosure will be apparent to those skilled in the art from consideration of the specification and practice of the disclosure disclosed herein. It is intended that the specification and examples be considered as exemplary only, with a true scope and spirit of the disclosure being indicated by the following claims.

The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A nested liner assembly, comprising:

a. a plurality of liners, a liner of the plurality of liners being inside a next liner of the plurality of liners, the liner having an edge defining an opening into an interior of the liner, the plurality of liners including an innermost liner and an outermost liner;

b. an insert operable to be inserted into a trash receptacle, the insert defining a channel and wherein the plurality of liners are configured to be removably attached to the insert, wherein the insert operable has an outer portion dimensioned to surround the trash receptacle, wherein the outer portion has a first end and a second end, and wherein the first end and the second end overlap;

c. a lifter dimensioned to fit into the channel; and d. at least one lift strap attached to the lifter and operable to lift the lifter from the channel of the insert.

2. The nested liner assembly of claim 1, wherein the insert has an inner wall and an outer wall, the outer wall configured to rest outside of a lidded trash receptacle when the insert is position on the trash receptacle and the inner wall is positioned inside the trash receptacle.

3. The nested liner assembly of claim 2, wherein the edge of the liner is stretched over the inner wall of the insert.

4. The nested liner assembly of claim 3, wherein the at least one lift strap is two lift straps.

5. The nested liner assembly of claim 1, wherein the outermost liner is a thicker liner relative to the other liners comprising the plurality of liners.

6. The nested liner assembly of claim 1, wherein the insert is operable to fit onto a lidded trash receptacle.

7. The nested liner assembly of claim 6, wherein when the insert is inserted into a trash receptacle, the trash receptacle has a lid with at least an open position and a closed position, and wherein the insert extends between the outside of the trash receptacle and the lid when the lid is in the open position.

8. The nested liner assembly of claim 1, wherein the insert operable comprises:

a. an inner portion comprising an inner wall and an outer wall;

b. the outer portion; and c. a belt connecting the inner portion to the outer portion.

9. The nested liner assembly of claim 8, wherein the trash receptacle has a rim with an interior and an exterior, and wherein the belt is made of a flexible material wherein the inner wall extends into the interior of the trash receptacle and the outer wall extends on the exterior of the trash receptacle when the belt of the insert is positioned on the rim of the trash receptacle.

10. The nested liner assembly of claim 8, wherein the inner wall and the outer wall of the inner portion comprise cardboard.

11. The nested liner assembly of claim 1, wherein the lifter includes fasteners operable to hold the plurality of liners to the lifter.

12. The nested liner assembly of claim 1, wherein the liner is made of plastic film.

13. The nested liner assembly of claim 1, wherein the plurality of liners comprises at least 10 liners.

14. A nested liner assembly comprising:

a plurality of liners, a liner of the plurality of liners being inside a next liner of the plurality of liners, the liner having an edge defining an opening into an interior of the liner, the plurality of liners including an innermost liner and an outermost liner;

an insert configured to be inserted into a trash receptacle, the insert defining a channel, wherein the insert is coupled to tubing such that the tubing is configured to be disposed within an interior of the trash receptacle, wherein the insert has an outer portion dimensioned to surround the trash receptacle, wherein the outer portion has a first end and a second end, and wherein the first end and the second end overlap;

a loading device configured to fit into the channel, wherein the plurality of liners is removably attached to the loading device; and at least one lift strap attached to the loading device and operable to lift the loading device from the channel of the insert.

15. The nested liner assembly of claim 14, wherein the loading device comprises a metal, metal alloys, or a plastic polymer or a combination thereof.

16. An insert comprising:

An outer shell disposed adjacent an inner shell concentric with the outer shell wherein the outer shell and the inner shell are connected by a block; and a plurality of liners, a liner of the plurality of liners being inside a next liner of the plurality of liners, the liner having an edge defining an opening into an interior of the liner, the plurality of liners including an innermost liner and an outermost liner, wherein the plurality of liners are disposed between the inner concentric shell and the outer concentric shell such that an interior of the plurality of liners extends beyond the inner and outer concentric shells, wherein the plurality of liners are connected via one or more pairs of ribbons wherein each ribbon pair has ends affixed to a first liner and second ends passing through openings of a preceding liner in the plurality of liners.

* * * * *